US005642036A

United States Patent [19]

Horikawa

[11] Patent Number: 5,642,036

[45] Date of Patent: Jun. 24, 1997

[54] ELECTRICAL CONSUMPTION STABILIZING METHOD AND APPARATUS

[75] Inventor: Takashi Horikawa, Tokyo, Japan

[73] Assignee: NEC Corporation, Tokyo, Japan

[21] Appl. No.: 451,678

[22] Filed: May 26, 1995

[30] Foreign Application Priority Data

Jul. 21, 1994 [JP] Japan ..... 6-169132

[51] Int. Cl.[6] ..... G05F 5/00

[52] U.S. Cl. ..... 323/299

[58] Field of Search ..... 323/299, 901, 323/908, 282, 284

[56] References Cited

U.S. PATENT DOCUMENTS 4,791,544 12/1988 Gautherin et al. ..... 363/49

*Primary Examiner*—Peter S. Wong

*Assistant Examiner*—Rajnikant B. Patel

*Attorney, Agent, or Firm*—Scully, Scott, Murphy & Presser

[57] ABSTRACT

The present invention limits the rate of variation of electrical consumption in a device composed of a circuit employing a semiconductor element in which electrical consumption varies according to the amount of change in circuit state by supplying a dummy signal to the circuit when the standard input circuit is cut off and by using a dummy signal to cause electrical consumption to gradually increase at the time of recovery of the standard input signal. The invention includes, for a circuit that is normally connected to a power source and supplied with a standard input signal, a dummy signal generation circuit that supplies a dummy signal upon cut-off or recovery of said standard input signal, a timing circuit that controls the time of switching, a selection circuit that outputs to the circuit either the standard input signal or the dummy signal according to the output of the timing circuit, a monitoring circuit that detects the standard input signal, and an output signal stopping circuit that stops the output of the circuit during input of the dummy signal.

4 Claims, 3 Drawing Sheets

ELECTRICAL CONSUMPTION STABILIZING METHOD AND APPARATUS

BACKGROUND OF THE INVENTION

1. Field of the Invention

The present invention relates to an electrical consumption stabilizing method and apparatus, and particularly to an electrical consumption stabilizing method and apparatus for a device composed of circuits that use a semiconductor element in which electrical consumption varies according to the state of the internal circuit.

2. Description of the Related Art

Generally, electrical consumption stabilizing systems of the prior art maintain a fixed load component by providing, for example, a resistance on the power source side to reduce the rate of change in electrical consumption in the device as a whole.

FIG. 1 is a block diagram showing one example of an electrical consumption stabilizing system of the prior art having a circuit 2 in which electrical consumption varies according to the state of an inputted standard input signal 1 and resistance 3 that continually consumes a fixed amount of electrical power regardless of standard input signal 1.

As to the operation of this system, circuit 2 consumes electrical power through its internal operation when standard input signal 1 is normally inputted. When input of standard input signal 1 to circuit 2 is cut off, operation of circuit 2 stops, and output signal 4 of circuit 2 consequently also stops, causing electrical consumption to virtually halt. Consequently, if the only load on the power source is circuit 2, the output from the power source cannot maintain a stable state due to the drastic change in energy consumption of the device between the states of normal input and cut-off of standard input signal 1. Accordingly, by adding resistance 3, which consumes a fixed amount of electrical power regardless of the state of standard input signal 1, on the power source side, the rate of change in power consumption of the device as a whole can be decreased.

As described hereinabove, the electrical consumption stabilization system of the prior art necessitates the addition of resistance having no essential function to ensure that electrical consumption is constant regardless of the state of the standard input signal, and because current always flows through resistance, extra electricity is consumed by the resistance even during normal input of the standard input signal.

SUMMARY OF THE INVENTION

The object of the present invention is to provide an electrical consumption stabilization method and apparatus that limits the rate of variation in electrical consumption by supplying a dummy signal to a circuit when input of the standard input signal is cut off, and when input of the standard input signal is resumed, gradually increasing electrical consumption by the dummy signal before switching from the dummy signal to the standard input signal.

The electrical consumption stabilizing method and apparatus of the present invention is a means for solving the above-described problems. The electrical consumption stabilizing method of the present invention includes an electrical consumption stabilizing process comprising:

limiting the rate of variation in electrical consumption by supplying a dummy signal to the circuit and causing consumption of electrical power in the circuit immediately when input of the standard input signal is cut off, limiting the rate of variation in electrical consumption by gradually increasing electrical consumption in the circuit by changes of the dummy signal generation pattern with time before switching from the dummy signal to the standard input signal.

The electrical consumption stabilizing apparatus of the present invention includes an electrical consumption stabilizing circuit comprising:

a dummy signal generation circuit for generating a dummy signal that is outputted to the circuit during cut-off of the standard input signal to the circuit and that decreases the amount of variation in electrical consumption by causing consumption of electrical power, and, upon recovery of the standard input signal, the generation pattern of the dummy signal changes with time such that electrical consumption gradually increases, thereby limiting to a low level the amount of variation in electrical consumption at the time of switching to the standard input signal;

a timing circuit for outputting a signal immediately upon cut-off of the standard input signal or at a certain time after recovery of the standard input signal; and a selection circuit for receiving the standard input signal and the output signal of dummy signal generation circuit, selecting one of the signals according to the output signal of timing circuit, and outputting the selected signal to the circuit.

In addition, the apparatus includes standard input signal cut-off monitoring circuit for detecting information regarding cut-off and recovery of standard input signal, this cut-off and recovery determining the amount of variation in the state of the circuit.

Furthermore, the apparatus includes output signal stopping circuit which is linked with selection circuit for forcibly stopping output signal in accordance with the output signal of timing circuit, when the circuit is operating under a dummy signal.

In an electrical consumption stabilizing circuit structured as described hereinabove, during normal input of the standard input signal, selection circuit selects standard input signal and outputs to the circuit. The circuit operates normally under standard input signal and consumes electrical power. When the standard input signal is cut off, standard input signal cut-off monitoring circuit detects the cut-off, outputs to timing circuit and dummy signal generation circuit, and through immediate communication by timing circuit to selection circuit, selection circuit selects and outputs a dummy signal to the circuit. Upon recovery of standard input signal, through communication by timing circuit to selection circuit, selection circuit selects and outputs the recovered standard input signal after a fixed interval of time.

During cut-off of the standard input signal, the circuit operates under the input of the dummy signal in place of the standard input signal and consumes electrical power. Upon recovery of the standard input signal, dummy signal generation circuit outputs a signal such that electrical consumption by the circuit gradually increases from the time of receiving notice of recovery from standard input signal cut-off monitoring circuit until the standard input signal is inputted to the circuit in response to timing circuit.

During the time that the circuit operates under the dummy signal, to prevent erroneous operation in devices downstream in the flow of signals due to the dummy signal, output signal stopping circuit operates to forcibly stop output signals according to the output of timing circuit.

The above and other objects, features, and advantages of the present invention will become apparent from the following description based on the accompanying drawings which illustrate an example of a preferred embodiment of the present invention.

Figure 1:
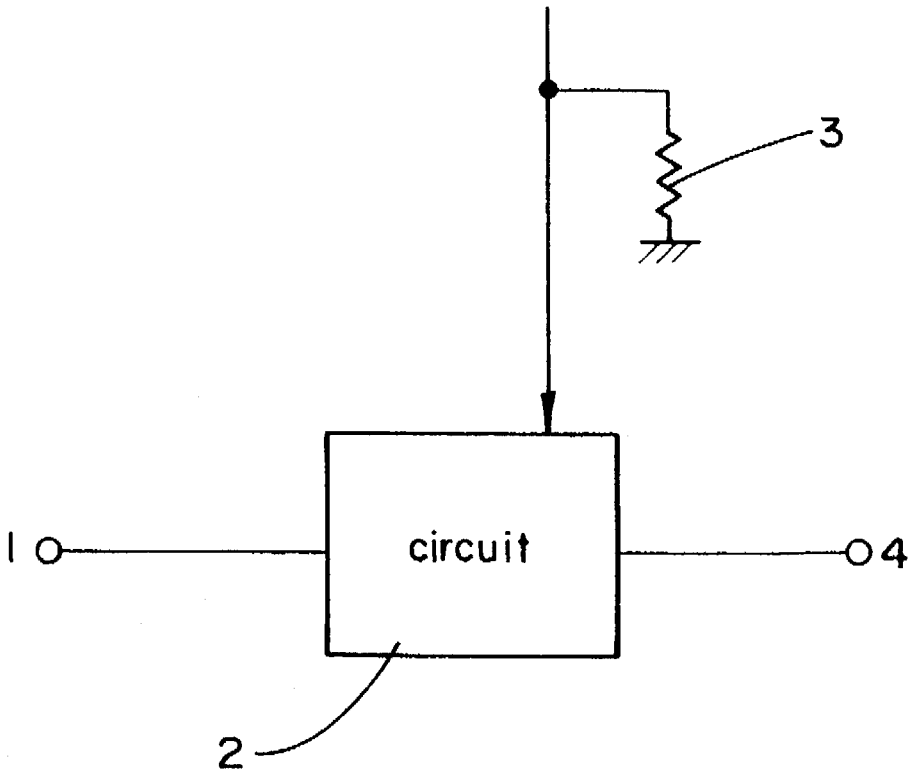
FIG. 1 (PRIOR ART)
FIG. 1 is a block diagram showing an example of the prior art.

REFERENCE NUMERALS 1 standard input signal
2 circuit
3 resistance
4 output signal
5 standard input signal cut-off monitoring circuit
6 dummy signal generation circuit
7 selection circuit
8 output signal stopping circuit
9 timing circuit
10 electrical consumption stabilizing circuit

DETAILED DESCRIPTION OF THE PREFERRED EMBODIMENTS

Figure 2:
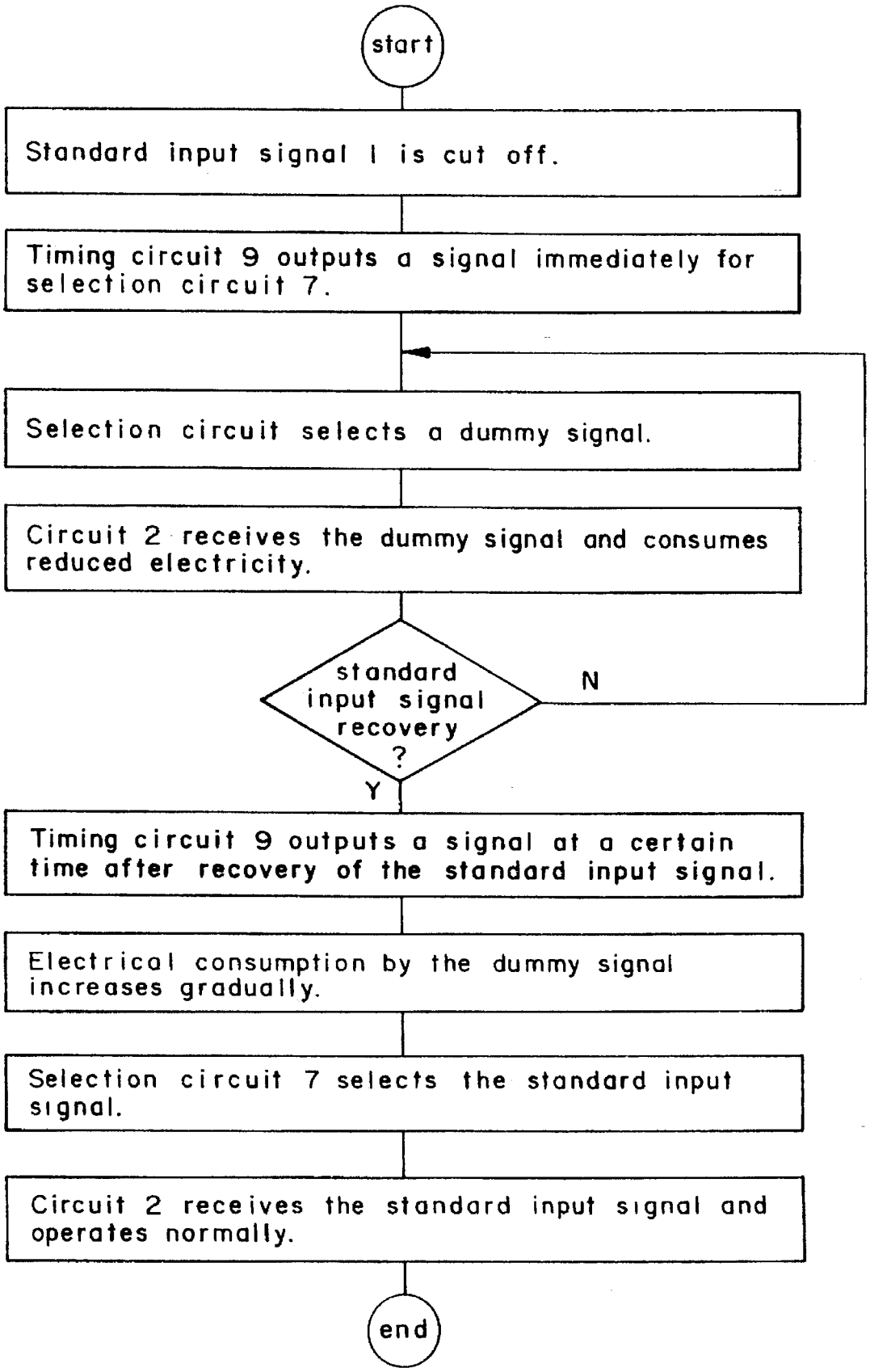
FIG. 2 is a flowchart illustrating the method of the present invention.
Figure 3:
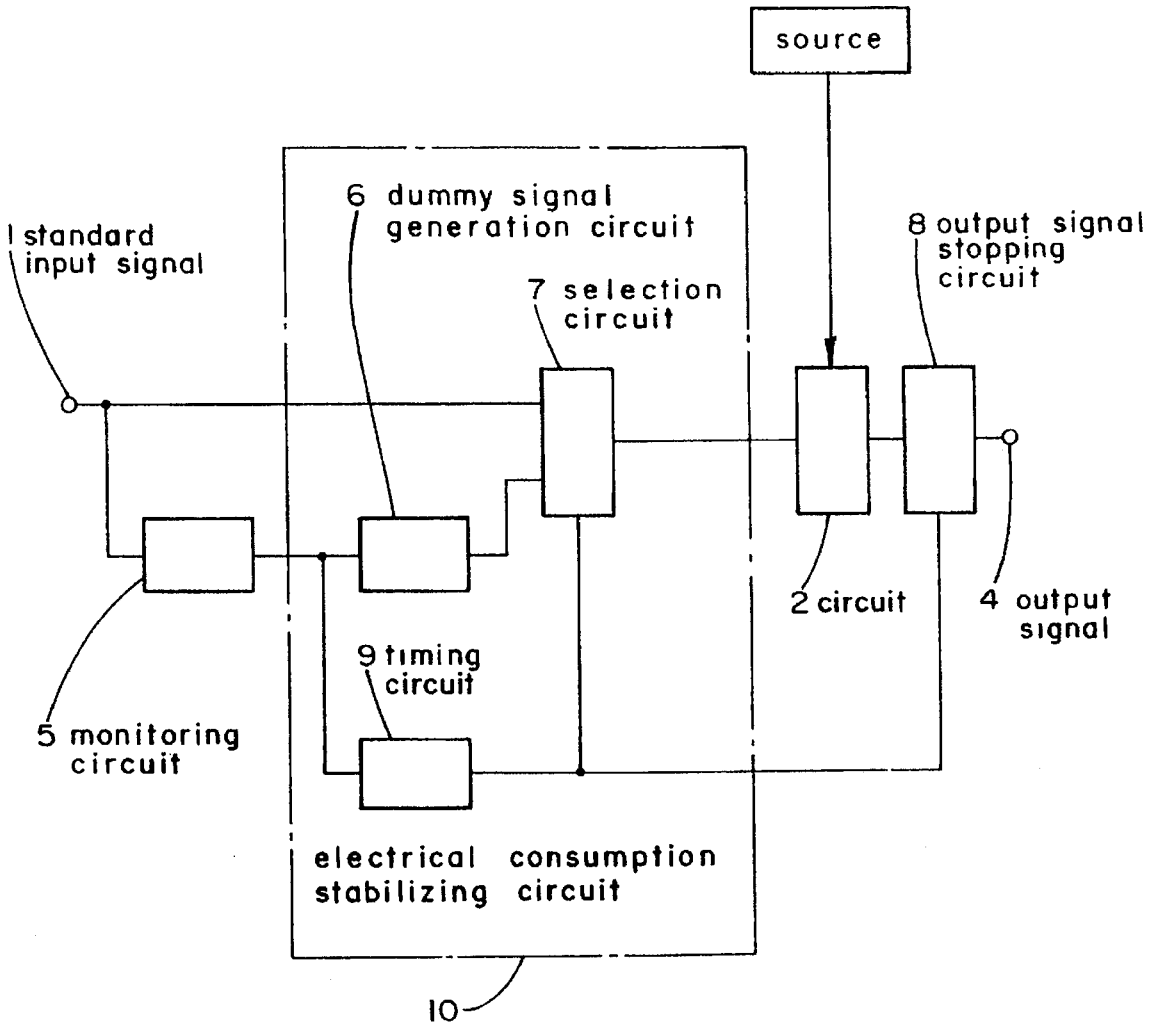
FIG. 3 is a block diagram showing an embodiment of the present invention.

An embodiment of the present invention will next be explained with reference to the figures. FIG. 2 is a flowchart and FIG. 3 is a block diagram showing the present invention. The use of identical reference numerals for constituent elements in FIG. 1 and FIG. 3 indicates that the elements are equivalent. The electrical consumption stabilizing apparatus of FIG. 3 includes electrical consumption stabilizing circuit 10 composed of dummy signal generation circuit 6 for generating dummy signals, timing circuit 9 for outputting a signal immediately upon cut-off of the standard input signal and at a specific timing upon recovery of the standard input signal, and selection circuit 7 for selecting between the standard input signal and the dummy signal and outputting to circuit 2 in accordance with a signal at a timing from timing circuit 9; standard input signal cut-off monitoring circuit 5 for monitoring input and cut-off of standard input signal 1; and signal output stopping circuit 8 for forcibly stopping the output of circuit 2 in accordance with the output of timing circuit 9 upon detection of cut-off of the standard input signal.

Regarding the operation in FIG. 2 and FIG. 3, during normal input of standard input signal 1, selection circuit 7 selects standard input signal 1 based on the output information of standard input signal cut-off monitoring circuit 5 and outputs the signal to circuit 2. Circuit 2 operates normally under standard input signal 1 and consumes electrical power.

If standard input signal 1 is cut off, standard input signal cut-off monitoring circuit 5 detects the cut-off and outputs to timing circuit 9 and dummy signal generation circuit 6. Immediately upon standard input signal cut-off or at a timing after standard input signal recovery, timing circuit 9 notifies selection circuit 7, whereupon selection circuit 7, upon standard input signal cut-off, immediately selects the dummy signal which is the output of dummy signal generation circuit 6, or upon standard input signal recovery, selects the recovered standard input signal at a set timing after recovery, and outputs to circuit 2. Circuit 2, during standard input signal cut-off, operates under the dummy signal in lieu of the standard input signal and consumes electrical power accordingly.

Through selection of the signal pattern of the dummy signal generated at this time, despite a considerable drop in electrical consumption in comparison with a state during input of standard input signal 1, reduced electrical consumption is possible while maintaining stable output of the power source. Upon standard input signal recovery, dummy signal generation circuit 6, after receiving notification of recovery from standard input signal cut-off monitoring circuit 5, outputs a signal according to the output signal of timing circuit 9 until standard input signal 1 is inputted such that electrical consumption by circuit 2 gradually increases.

Because the above-described dummy signal serves only to cause electrical consumption by circuit 2, output of the circuit 2 during input of the dummy signal will differ from output during input of standard input signal 1, and this difference can lead to erroneous operation in devices downstream in the signal flow. To prevent this error, output signal stopping circuit 8 works together with selection circuit 7 in accordance with the output of timing circuit 9 to forcibly stop output signals when circuit 2 operates under dummy signals.

As explained hereinabove, in a device composed of a circuit employing elements in which electrical consumption varies according to the state of the standard input signal, the present invention prevents drastic changes in electrical consumption by supplying a dummy signal to the circuit 2 when cut-off of the standard input signal occurs, or upon recovery, by gradually causing electrical consumption to increase before switching to the standard input signal, thereby enabling stabilization of the output of the power source, and preventing problems occurring due to power source voltage drops caused by sudden changes in the current load. Furthermore, superfluous devices such as the resistance used in the prior art need not be employed, thereby providing the effect that superfluous electrical consumption during normal input of the standard input signal can be eliminated. In addition, erroneous operation by devices on the downstream side can be prevented by forcibly stopping output signals occurring when circuit 2 is caused to operate by a dummy signal.

It is to be understood, however, that although the characteristics and advantages of the present invention have been set forth in the foregoing description, the disclosure is illustrative only, and changes may be made in the arrangement of the parts within the scope of the appended claims.

What is claimed is:

1. A method for stabilizing an electrical consumption in a load circuit made up of elements in which electrical consumption varies according to an amount of change in a state of the load circuit to which normally a standard input signal is provided, the method comprising:

limiting a rate of variation in electrical consumption by supplying a dummy signal to the load circuit and causing consumption of electrical power in the load circuit when the standard input signal is cut off; and limiting the rate of variation in electrical consumption when input of the standard input signal to the load circuit is resumed, by gradually increasing electrical consumption in the load circuit by changing the dummy signal generation pattern with time before switching from the dummy signal to the standard input signal.

2. An electrical consumption stabilizing apparatus constructed to conduct a standard input signal to a load circuit made up of elements in which electrical consumption varies according to an amount of change in a state of the load circuit, comprising:

a dummy signal generation circuit for generating a dummy signal that is outputted to the load circuit during cut-off of said standard input signal to the load circuit to decrease the amount of variation in electrical consumption by causing consumption of electrical power, wherein, upon recovery of said standard input signal, the dummy signal pattern changes with time such that electrical consumption gradually increases before switching from the dummy signal to the standard input signal, thereby limiting to a low level the amount of variation in electrical consumption at the time of switching to the standard input signal;

a timing circuit for outputting a timing signal immediately upon cut-off of said standard input signal or at a certain time after recovery of said standard input signal; and a selection circuit for receiving said standard input signal and said dummy signal, for selecting one of the dummy and standard input signals in accordance with said timing signal from said timing circuit, and for outputting the selected signal to said load circuit.

3. An electrical consumption stabilizing apparatus according to claim 2 further including a standard input signal cut-off monitoring circuit for detecting information regarding cut-off and recovery of said standard input signal, said cut-off and recovery determining the amount of variation in the state of said load circuit.

4. An electrical consumption stabilizing apparatus according to claim 2 further including an output signal stopping circuit for forcibly stopping an output signal when said load circuit operates under said dummy signal, said output signal stopping circuit operating in accordance with said timing signal.

* * * * *